US009802077B2

(12) United States Patent
MacDonald

(10) Patent No.: US 9,802,077 B2
(45) Date of Patent: Oct. 31, 2017

(54) EXERCISE APPARATUS HAVING A STATIONARY INNER PLATFORM AND AN OUTER ANNULAR MEMBER ROTATABLY CONNECTED THERETO

(71) Applicant: Ross MacDonald, Surrey (CA)

(72) Inventor: Ross MacDonald, Surrey (CA)

(73) Assignee: My Turn Health and Fitness Limited, Whistler (CA)

( * ) Notice: Subject to any disclaimer, the term of this patent is extended or adjusted under 35 U.S.C. 154(b) by 89 days.

(21) Appl. No.: 14/796,940

(22) Filed: Jul. 10, 2015

(65) Prior Publication Data

US 2016/0074702 A1 Mar. 17, 2016

Related U.S. Application Data

(60) Provisional application No. 62/051,870, filed on Sep. 17, 2014.

(51) Int. Cl.
*A63B 22/14* (2006.01)
*A63B 26/00* (2006.01)
(Continued)

(52) U.S. Cl.
CPC ..... *A63B 22/14* (2013.01); *A63B 21/00065* (2013.01); *A63B 21/225* (2013.01);
(Continued)

(58) Field of Classification Search
CPC ..... A63B 21/00065; A63B 21/023; A63B 21/0608; A63B 21/0609; A63B 21/0618; A63B 21/225; A63B 21/227; A63B 21/4034; A63B 21/4049; A63B 22/14; A63B 23/00; A63B 23/02; A63B 23/0205; A63B 23/0211; A63B 23/0216;
(Continued)

(56) References Cited

U.S. PATENT DOCUMENTS 1,521,946 A * 1/1925 Hargreaves ..... A63G 1/16 482/147
3,441,271 A * 4/1969 Palacios ..... A63B 22/14 472/14
(Continued)

FOREIGN PATENT DOCUMENTS

| | | |
|---|---|---|
| CN | 201558460 | 8/2010 |
| CN | 203329275 | 5/2013 |
| WO | 03009909 | 2/2003 |

OTHER PUBLICATIONS

International Search Report and Written Opinion of PCT/CA2015/050698, dated Oct. 27, 2015.
(Continued)

*Primary Examiner* — Joshua Lee
(74) *Attorney, Agent, or Firm* — Cameron IP

(57) ABSTRACT

There is accordingly provided an exercise apparatus including an inner housing upon which a user may stand. The apparatus includes an outer housing rotatably coupled to the inner housing. The apparatus includes a handlebar coupled to and extending upwards from the outer housing. The apparatus includes a mount for retaining one or more weights thereon. The mount operatively connects to the outer housing and is enclosed within one of the housings.

19 Claims, 14 Drawing Sheets

(51) Int. Cl.

| | |
|---|---|
| ***A63B 21/06*** | (2006.01) |
| ***A63B 21/02*** | (2006.01) |
| ***A63B 21/00*** | (2006.01) |
| ***A63B 23/00*** | (2006.01) |
| ***A63B 21/22*** | (2006.01) |
| ***A63B 23/02*** | (2006.01) |

(52) U.S. Cl.
CPC ..... *A63B 23/00* (2013.01); *A63B 23/0205* (2013.01); *A63B 21/023* (2013.01); *A63B 2023/003* (2013.01); *A63B 2208/0204* (2013.01); *A63B 2210/50* (2013.01); *A63B 2225/093* (2013.01)

(58) Field of Classification Search
CPC ..... A63B 23/0222; A63B 23/0227; A63B 2023/003; A63B 2210/50; A63B 2225/093; A63B 2208/0204
See application file for complete search history.

(56) References Cited

U.S. PATENT DOCUMENTS 3,593,994 A * 7/1971 Anbar ..... A63B 22/14 482/147
3,784,193 A * 1/1974 Simjian ..... A63B 22/14 482/118
4,305,579 A 12/1981 Rice
4,319,749 A 3/1982 Agyagos
4,505,476 A * 3/1985 Rubin ..... A63B 22/02 482/147
4,976,425 A * 12/1990 Barnes, Jr. ..... A63B 22/14 482/110
5,352,176 A * 10/1994 Huang ..... A63B 21/0004 482/123
5,454,774 A * 10/1995 Davis ..... A63B 22/18 434/258
5,562,572 A * 10/1996 Carmein ..... A61H 3/00 198/779
5,695,439 A 12/1997 Lin
5,807,210 A 9/1998 Devlin
6,152,854 A * 11/2000 Carmein ..... A63B 22/025 198/779
6,280,368 B1 * 8/2001 Liao ..... A63B 22/0061 482/146
6,875,159 B2 * 4/2005 Chuang ..... A63B 22/14 482/146
6,899,657 B2 * 5/2005 Chuang ..... A63B 22/001 482/147
7,081,074 B1 * 7/2006 Rubin ..... A63B 22/14 482/146
7,147,589 B2 * 12/2006 Chae ..... A63B 22/14 482/146
7,314,436 B1 * 1/2008 Rubin ..... A63B 22/14 473/131
7,648,444 B2 1/2010 Johnson
7,789,817 B2 * 9/2010 Wang ..... A63B 21/15 482/146
7,942,798 B2 * 5/2011 Wang ..... A63B 21/15 482/146
8,128,543 B1 * 3/2012 Liao Lai ..... A63B 23/0222 297/340
8,317,668 B2 * 11/2012 Sales ..... A63B 21/04 482/140
8,550,963 B1 * 10/2013 Bradford ..... A61H 1/0259 482/79
2002/0137610 A1 9/2002 Broudy et al.
2003/0092546 A1 * 5/2003 Yu ..... A61H 1/0255 482/142
2003/0195096 A1 10/2003 Hecox et al.
2004/0198507 A1 * 10/2004 Corbalis ..... A63B 69/0093 472/89
2005/0085352 A1 4/2005 Baxter
2006/0183604 A1 * 8/2006 Chae ..... A63B 22/14 482/51
2009/0054218 A1 * 2/2009 Tsai ..... A63B 22/14 482/147
2009/0105051 A1 4/2009 Sheets
2009/0163337 A1 6/2009 Petrakov
2010/0184571 A1 * 7/2010 Wang ..... A63B 21/15 482/133
2010/0184572 A1 * 7/2010 Wang ..... A63B 21/15 482/139
2010/0210429 A1 * 8/2010 Wang ..... A63B 21/15 482/127
2011/0312479 A1 * 12/2011 Caponigro ..... A63B 21/025 482/147
2012/0040812 A1 * 2/2012 Liao Lai ..... A63B 23/0222 482/142
2013/0165303 A1 6/2013 Niastro

OTHER PUBLICATIONS

"Press Release", dated Mar. 10, 2014: http://www.schaeffler-group.com/content.schaefflergroup.de/en/press/press-releases/press-details.jsp?id=54574402.
"File:Slewing bearing.jpg" From Wikipedia, the free encyclopedia, dated Aug. 22, 2014.
"Stewing bearing" From Wikipedia, the free encyclopedia, as set out in: http://web.archive.org/web/20130505133128/http://en.wikipedia.org/wiki/Slewing_bearing, dated May 5, 2013.
International Preliminary Report on Patentability for International Patent Application No. PCT/CA2015/050698, dated Dec. 20, 2016.
English Abstract of Chinese Patent Reference No. CN201558460.

* cited by examiner

EXERCISE APPARATUS HAVING A STATIONARY INNER PLATFORM AND AN OUTER ANNULAR MEMBER ROTATABLY CONNECTED THERETO

FIELD OF THE INVENTION

There is provided an exercise apparatus. In particular, there is provided an exercise apparatus having a stationary inner platform and an outer annular member rotatably connected thereto.

DESCRIPTION OF THE RELATED ART

U.S. Pat. No. 7,314,436 to Rubin discloses an exercise device having a first base member with foot platforms mounted thereon for rotating a person's lower body and a second base member including at least one handle to be grasped by a person for rotating a person's upper body. The first and second base members are mounted so as to be capable of rotating about the same vertical axis. Resistance means and/or weights may be used to increase the force needed to rotate the base members. Either base member may also be fixed so as not to rotate. Similarly, the foot platforms may rotate on the first base member independently of the first base member or can be fixed thereto so as to remain stationary in relation to the first base member. The second base member may be mounted adjacent the first base member and concentric therewith the handle extending upwardly. As seen in FIG. 1 thereof, weights may be added to the exercise device.

U.S. Pat. No. 4,305,579 to Rice discloses an apparatus upon which a person can do various different exercises. The apparatus includes a stationary base having two posts with handgrips. The apparatus includes a rotatable platform between the posts. The apparatus includes adjustable weights upon the platform. The apparatus includes two rotatable inclined pads stationarily located on the platform for standing upon. The apparatus includes a head brace supported on the posts. The apparatus includes an upwardly pull cord from a center of the platform for causing it to rotate.

The above systems may comprise a relatively large number of exposed parts. There may thus be an increased chance of the users of such systems to get caught on and/or injure themselves as a result thereof, for example. There may accordingly be a need for an improved exercise apparatus in this regard to address these and other issues.

BRIEF SUMMARY OF INVENTION

There is provided an improved exercise apparatus disclosed herein that may overcome the above disadvantages.

According to a first aspect, there is accordingly provided an exercise apparatus including an inner housing upon which a user may stand. The apparatus includes an outer housing rotatably coupled to the inner housing. The apparatus includes a handlebar coupled to and extending upwards from the outer housing. The apparatus includes a mount for retaining one or more weights thereon. The mount operatively connects to the outer housing and is enclosed within one of the housings.

According to another aspect, there is provided an exercise apparatus including an inner platform upon which a user may stand. The apparatus includes an outer annular member which is rotatable about a vertically-extending central axis. The outer annular member extends around and rotatably connects to the inner platform. The apparatus includes a geared bearing having an outer race operatively coupled to the inner platform and an inner race rotatably connected to the outer race. The inner race of the geared bearing operatively connects to the outer annular member.

According to a further aspect, there is provided an exercise apparatus including an inner platform upon which a user may stand. The apparatus includes an outer annular member which is rotatable about a vertically-extending central axis. The outer annular member extends around and rotatably connects to the inner platform. The apparatus includes an exercise resistance band coupled to and extending outwards from the inner platform.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
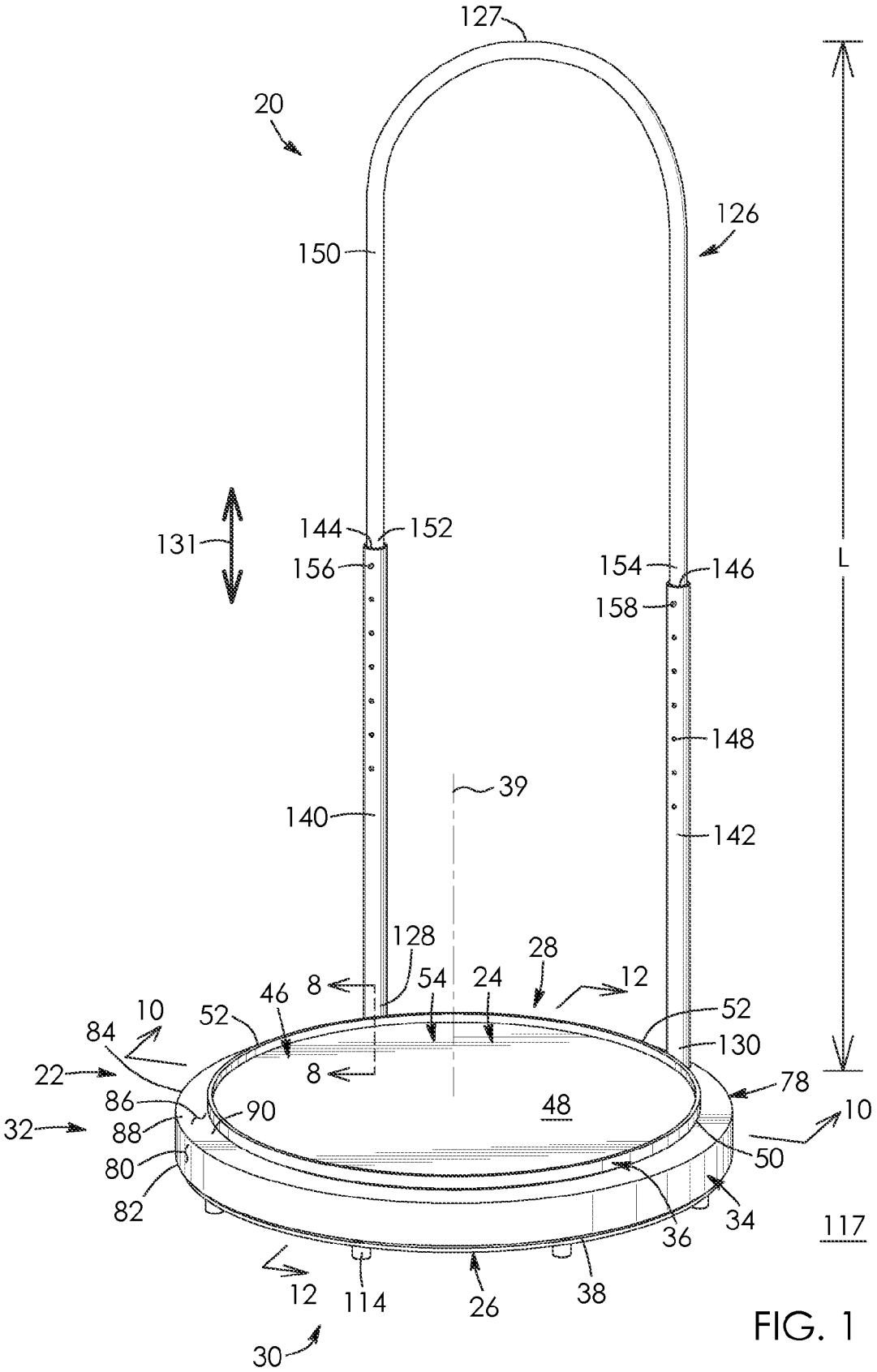
FIG. 1 is a perspective view of an exercise apparatus according to a first aspect, the exercise apparatus including a mounting assembly and a handlebar coupled thereto.

Referring to the drawings and first to FIG. 1, there is shown an exercise apparatus 20. The exercise apparatus includes a mounting assembly 22 best seen in FIG. 2.

Figure 2:
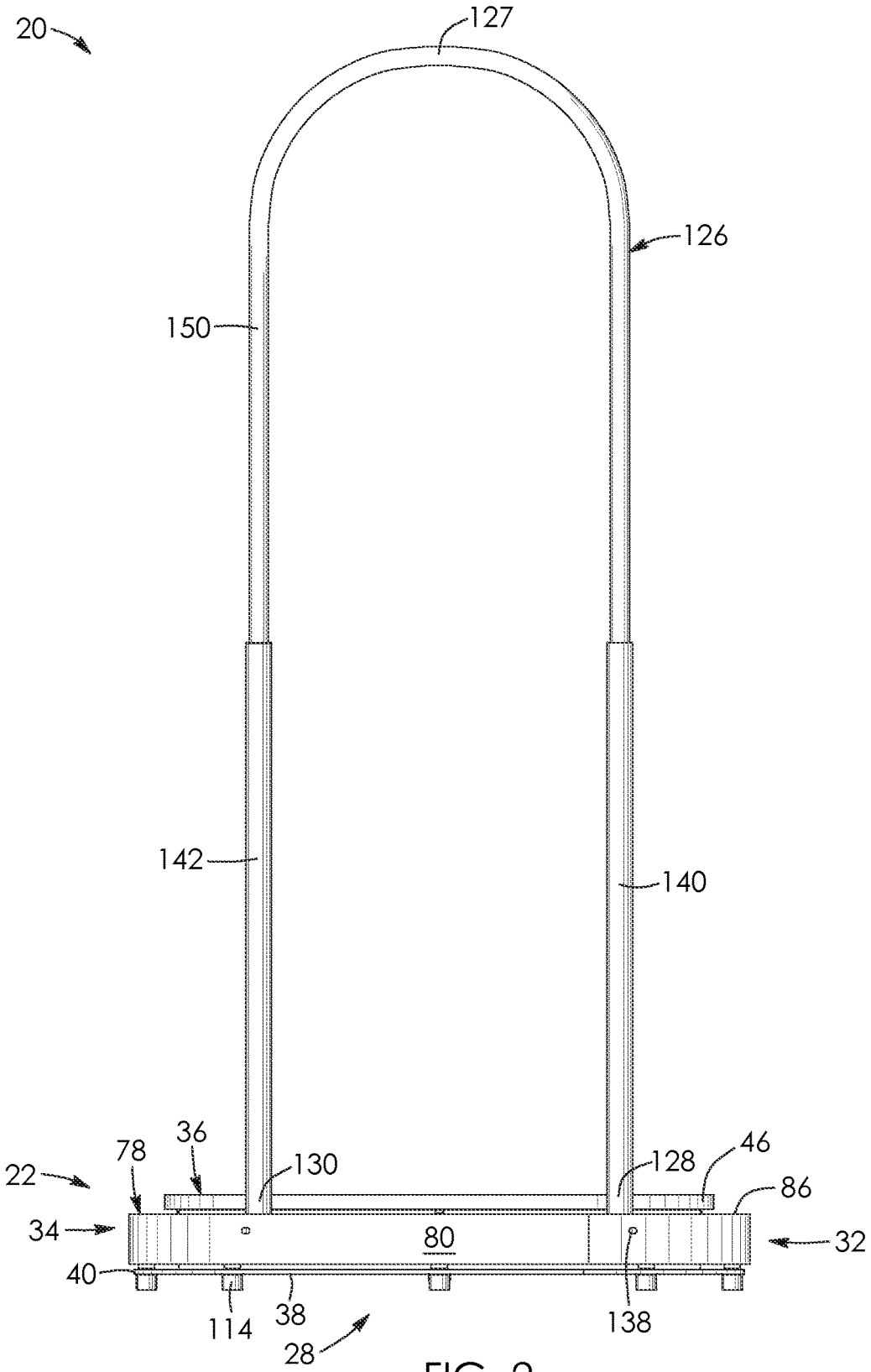
FIG. 2 is a front elevation view thereof.
Figure 3:
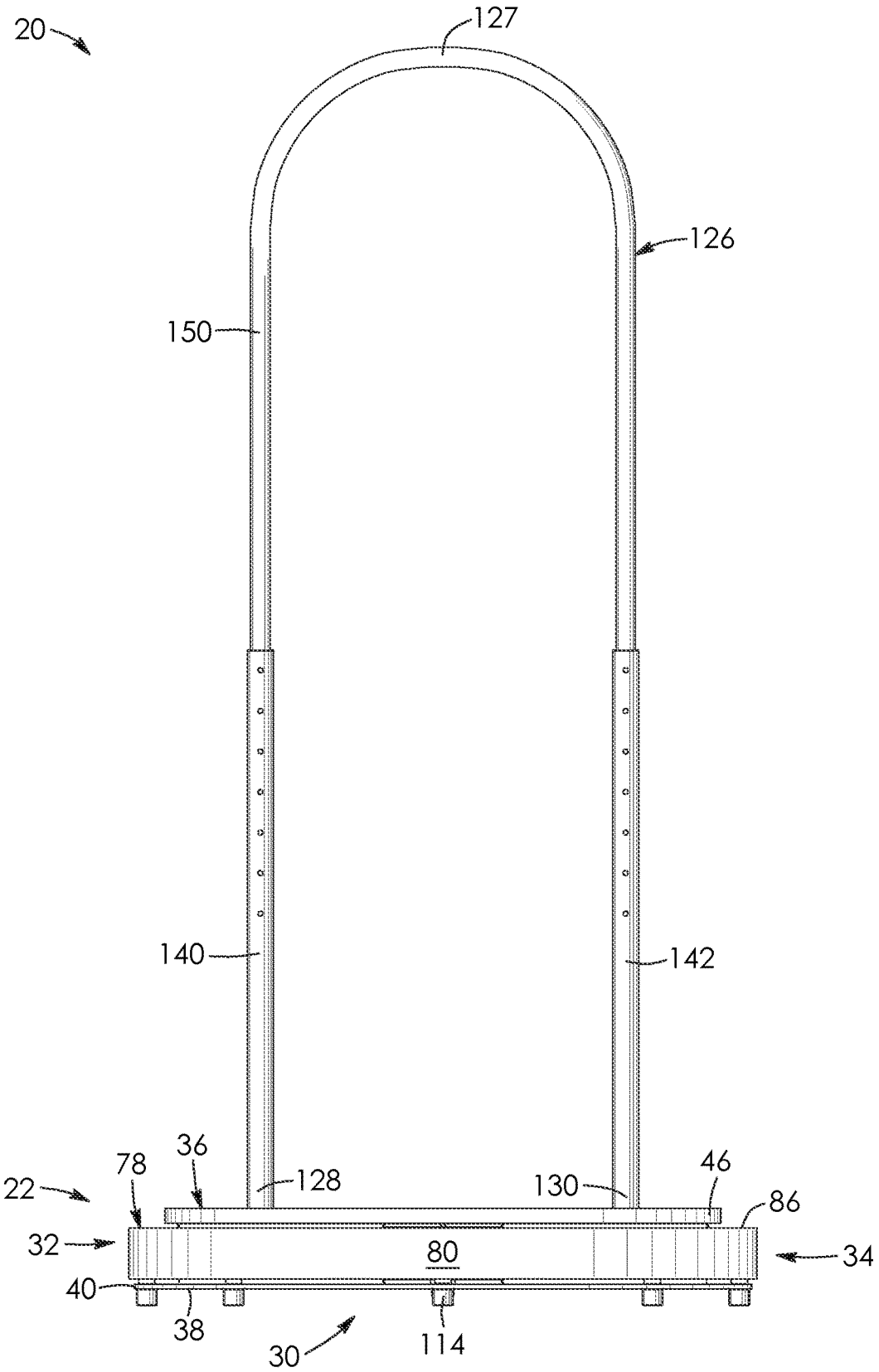
FIG. 3 is a rear elevation view thereof.
Figure 4:
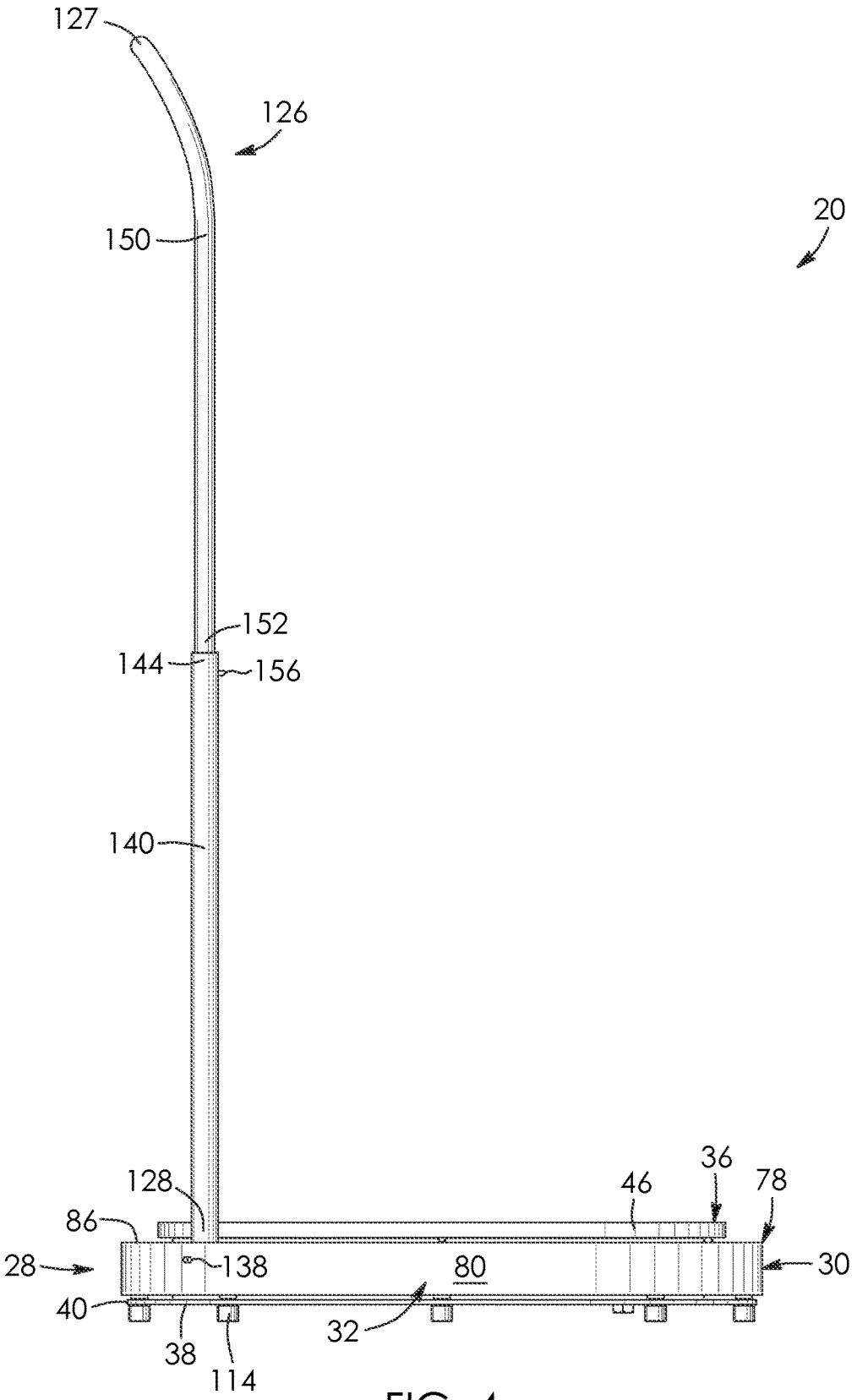
FIG. 4 is a right side elevation thereof.
Figure 5:
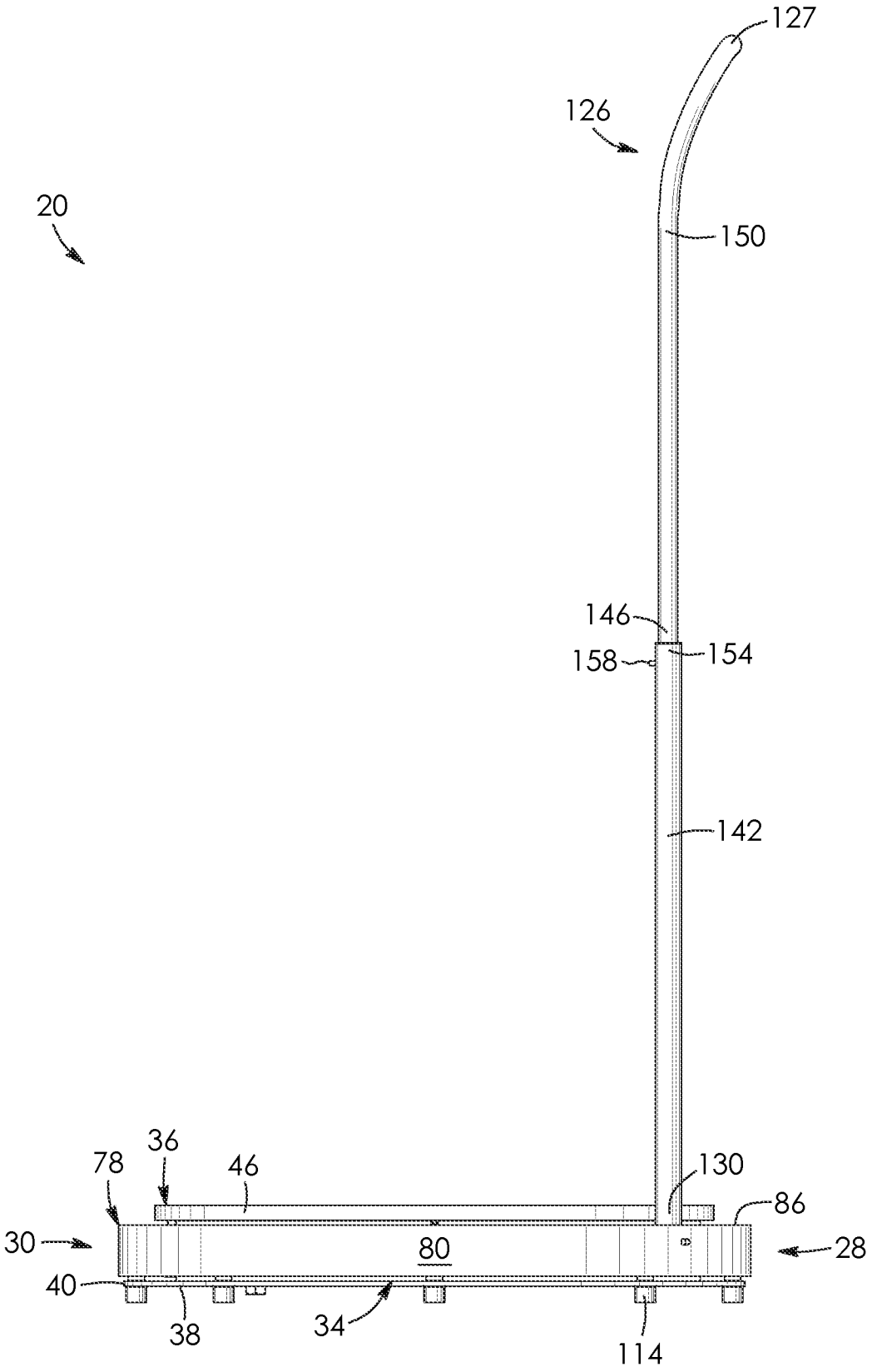
FIG. 5 is a left side elevation thereof opposite the left side elevation view of FIG. 4.
Figure 6:
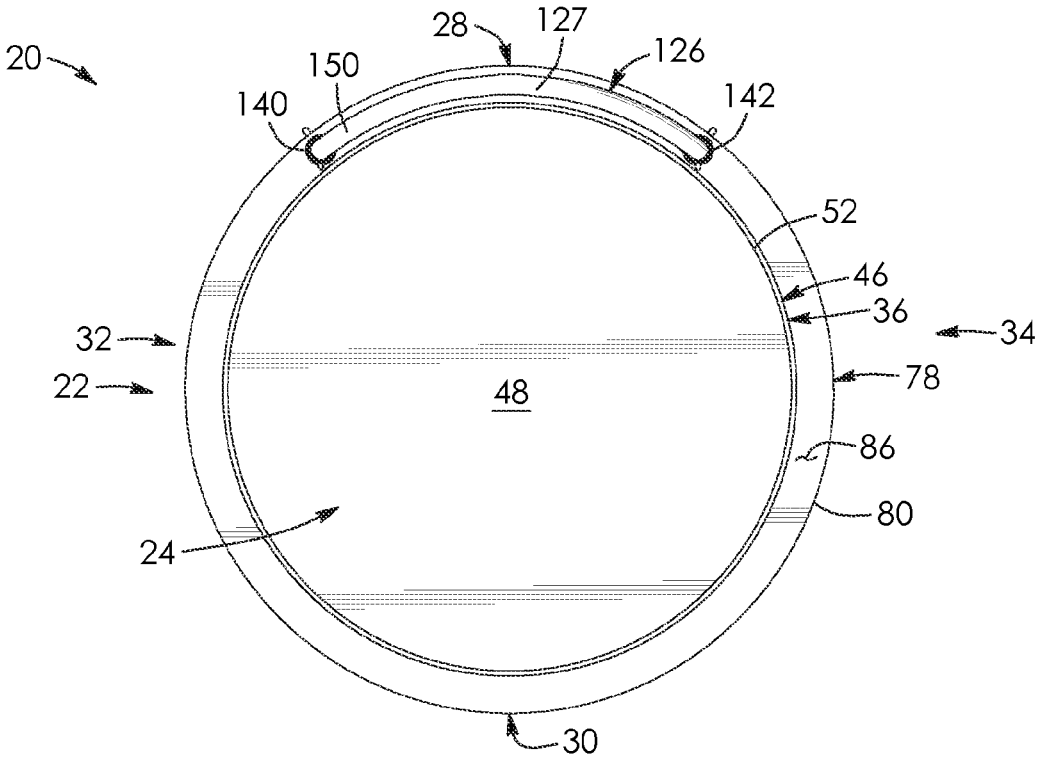
FIG. 6 is a top plan view thereof.
Figure 7:
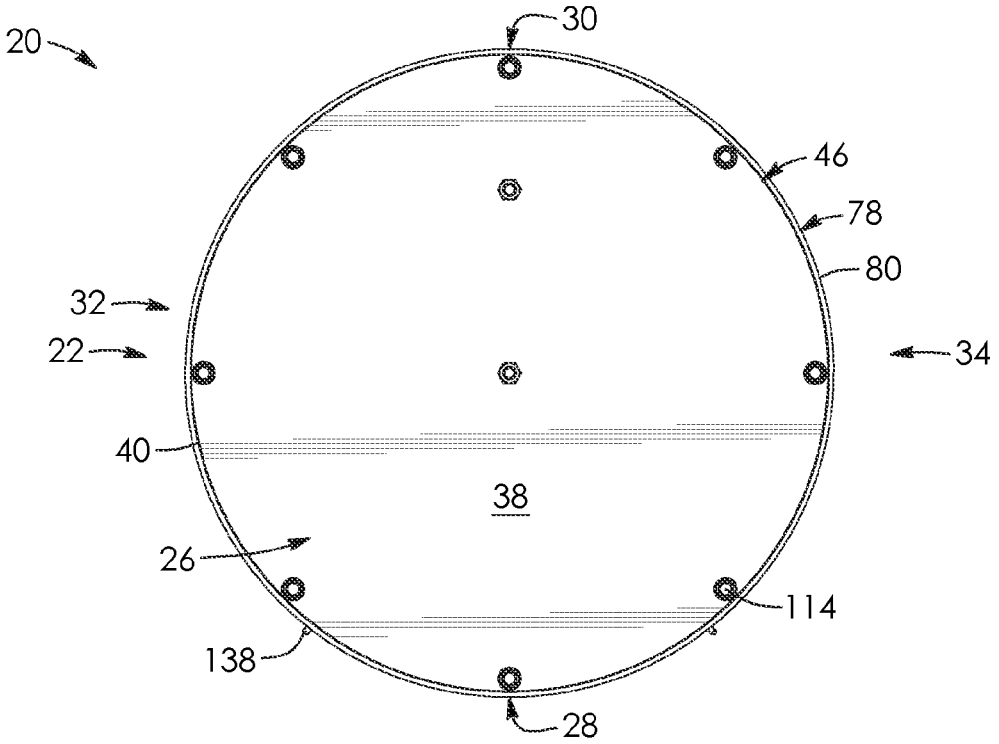
FIG. 7 is a bottom plan view thereof.

The mounting assembly has a top 24 best seen in FIG. 6, a bottom 26 which is opposite the top and best seen in FIG. 7, a front 28 best seen in FIG. 2, a rear 30 opposite the front and best seen in FIG. 3, and a pair of spaced-apart sides 32 and 34 best seen in FIGS. 4 and 5, respectively. As seen in FIG. 1, the front, rear and sides of the mounting assembly extend between the top and bottom thereof. The sides 32 and 34 of the assembly extend between the front 28 and rear 30 of the assembly.

Figure 10:
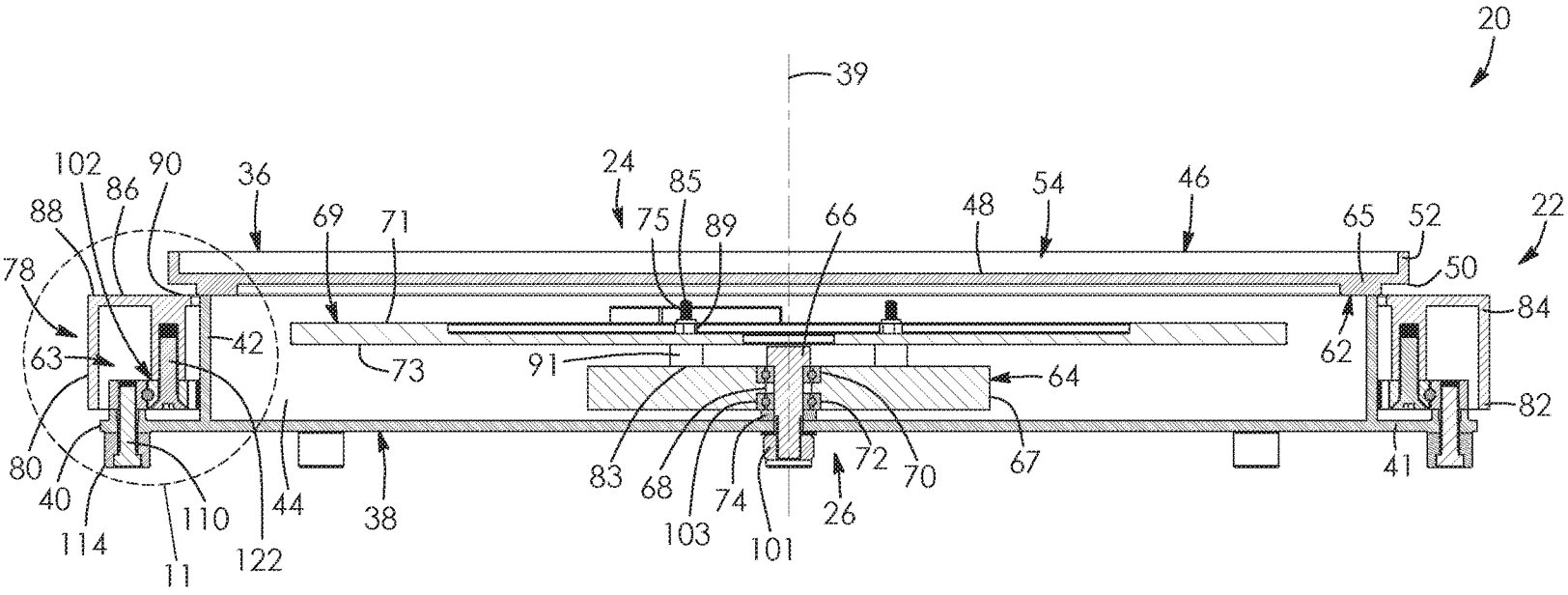
FIG. 10 is a cross-sectional view taken along lines 10-10 in FIG. 1 of the mounting assembly of FIG. 1.

As seen in FIG. 10, the mounting assembly includes an inner housing 36 which in this example includes a base member that is planar and in this example in the form of a circular base plate 38. The mounting assembly 22 has a vertically-extending central axis 39 which coincides and is co-axial with the axis of housing 36 and plate 38. The base plate is positioned adjacent to and extends parallel with the bottom 26 of the mounting assembly 22. As seen in FIG. 1, the base plate 38 extends between the sides 32 and 34, front 28 and rear 30 of the assembly. As seen in FIG. 10, the base plate has an outer annular edge 40 and an outer peripheral edge portion 41 which is annular and which extends radially inwards from the edge.

Figure 8:
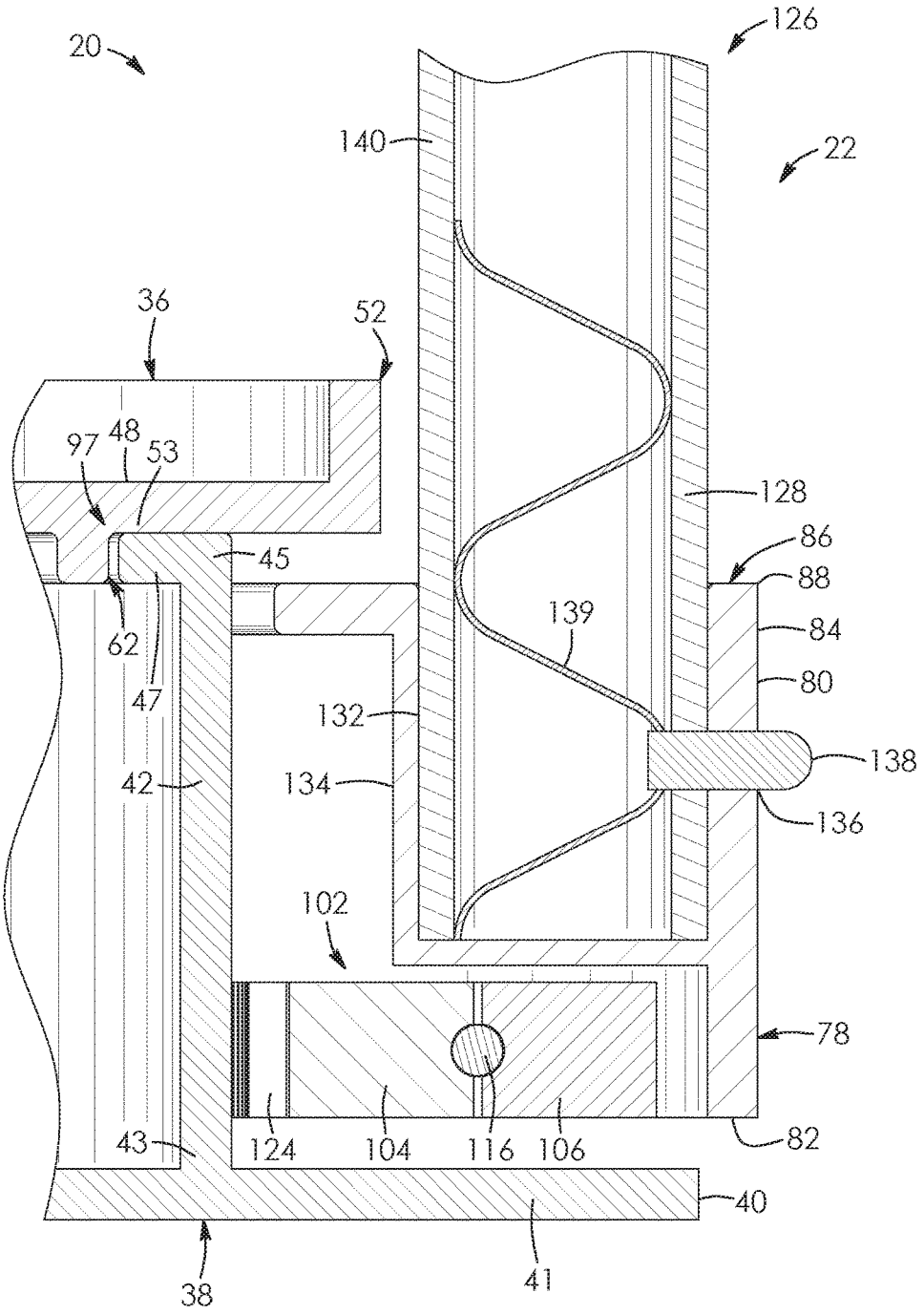
FIG. 8 is a cross-sectional view taken along lines 8-8 in FIG. 1 partially in fragment of the exercise apparatus of FIG. 1.
Figure 11:
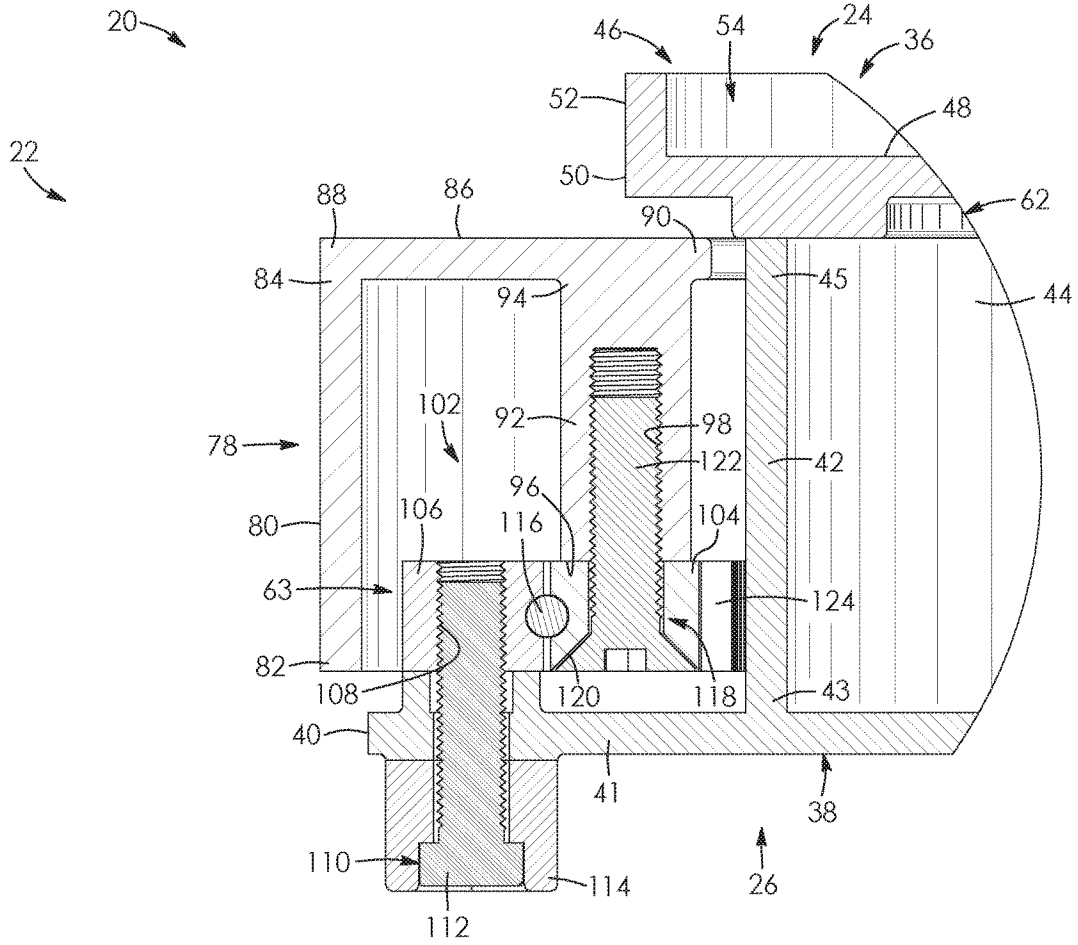
FIG. 11 is an enlarged view of part of the mounting assembly of FIG. 10.

The inner housing 36 further includes an annular peripheral portion in this example in the form of vertically-extending annular member 42. As seen in FIG. 11, the annular member has a first annular end 43 coupled to and extending upwards from base plate 38. The annular member is adjacent to and radially spaced-apart from the annular edge 40 of the base plate 38. As seen in FIG. 8, the outer peripheral edge portion 41 of base plate 38 extends between annular end 43 of member 42 and annular edge 40 of the member 42 in this example Annular member 42 and plate 38 are integrally connected together in this example and form an integrated whole.

Figure 9:
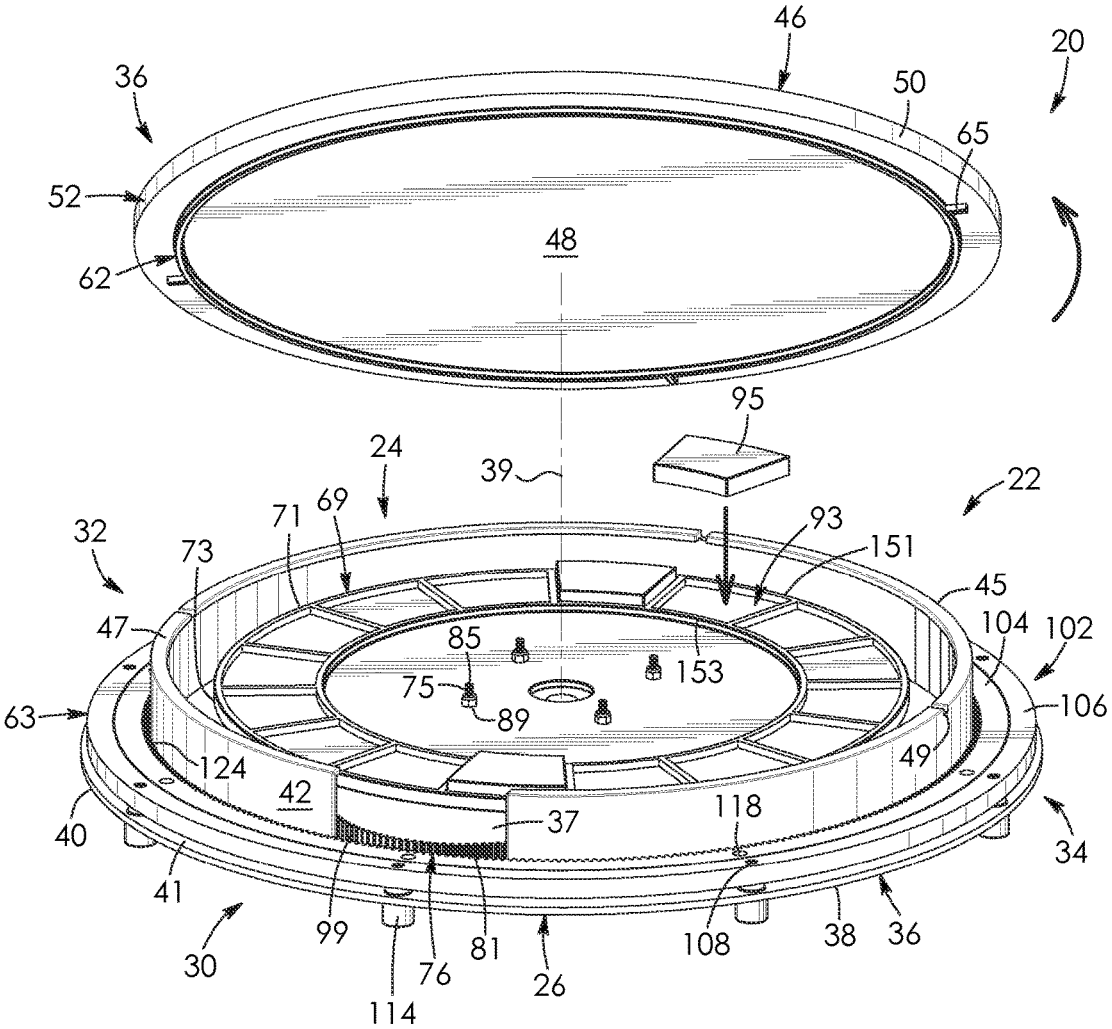
FIG. 9 is an exploded view of the mounting assembly of the exercise apparatus of FIG. 1, the mounting assembly including an inner platform that is removed to reveal interior components of the mounting assembly.

Annular member 42 further includes a second annular end 45 spaced-apart upwards from said first end 43 thereof. As seen in FIG. 9, the inner housing 36 has an opening 37 which is rectangular in this example and which extends through annular member 42 from end 43 to end 45 thereof.

As seen in FIG. 8, the annular member includes a radially-inwardly extending annular lip 47 at said second end thereof. End 45 and lip 47 of annular member 42 are positioned adjacent to top 24 of the mounting assembly 22 in this example. As seen in FIG. 9, annular member 42 includes a plurality of circumferentially spaced-apart slots which extend downwards from end 45 thereof towards end 43 thereof, as seen by slot 49.

As seen in FIG. 1, the exercise apparatus 20 includes a removable cover, in this example in the form of an inner platform 46 that is a planar member in this example in the form a centrally disposed circular plate 48 having a circular outer edge 50. The inner platform is part of the inner housing 36 in this example, and plate 38, annular member 42 and inner platform 46 of the inner housing 36 form a hollow interior 44 that is generally cylindrical in this example.

Figure 13:
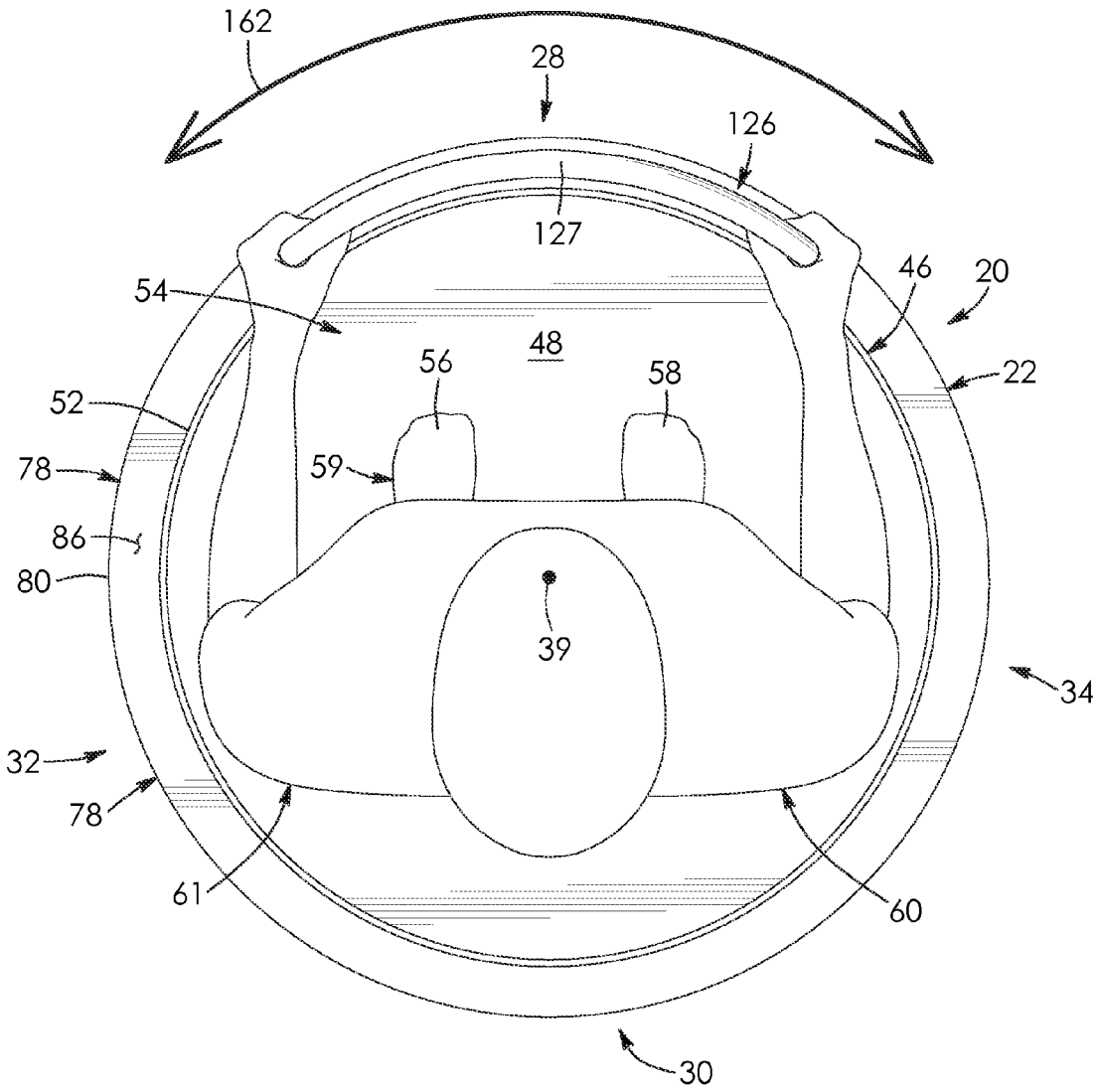
FIG. 13 is a top plan view of the exercise apparatus of FIG. 1, shown with a user gripping the handles thereof and where the user's body is in a first position.
Figure 14:
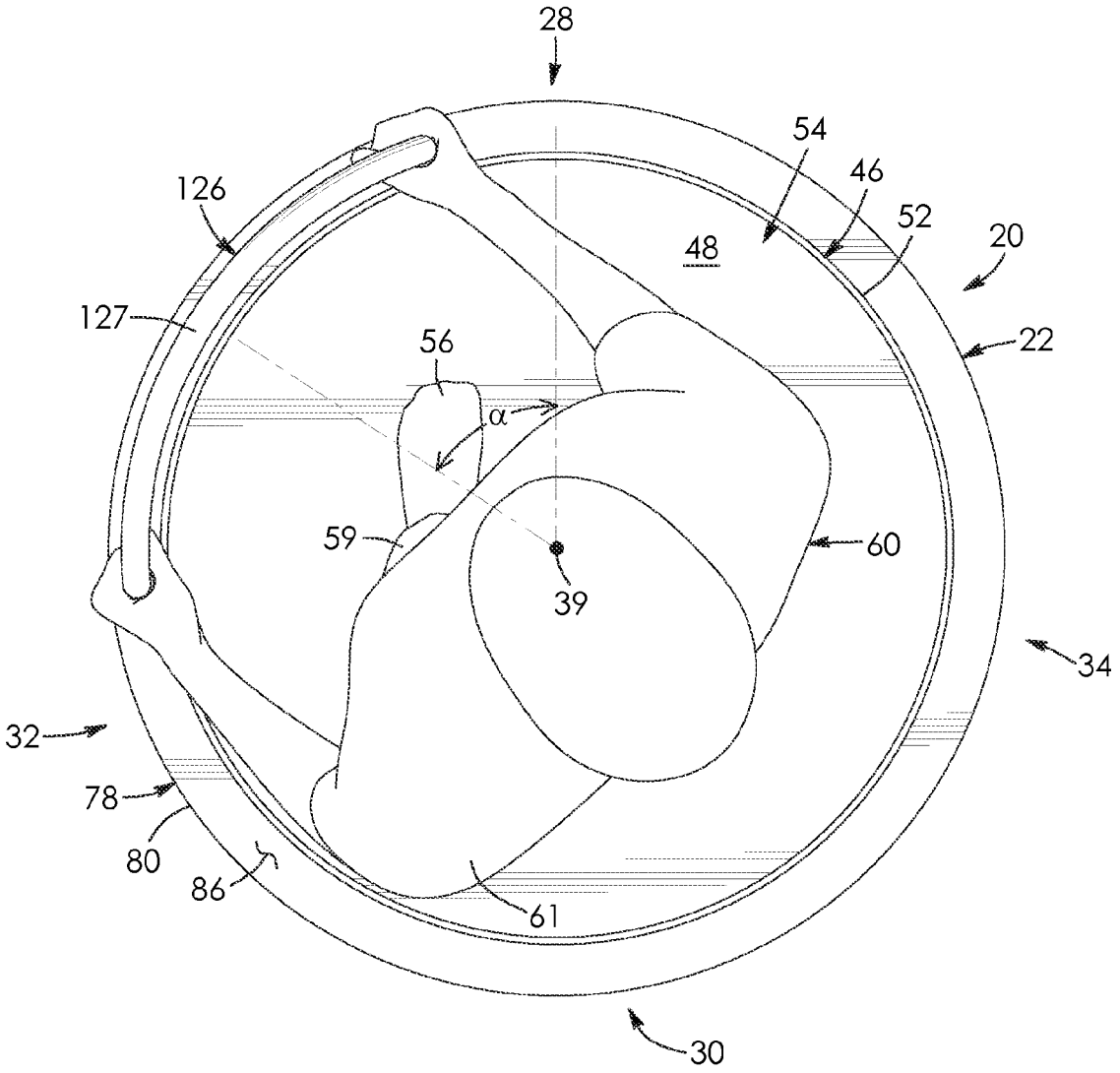
FIG. 14 is a top plan view of the exercise apparatus and user of FIG. 13, with the user's body being a second position in which the upper part of the user's body is rotated by 90 degrees to left relative to the first position of FIG. 13.

The inner platform includes an upper annular rim 52 integrally formed with and extending upwards from the outer edge 50 of plate 48 in this example. The upper rim of the inner plate generally aligns with the top 24 of the mounting assembly 22. As seen in FIGS. 13 and 14, plate 48 and rim 52 form a hollow cylindrically-shaped enclosure 54 shaped to receive feet 56 and 58 of a user 60. As seen in FIG. 11, the upper rim 52 of the inner platform 46 is adjacent to and radially-outwardly spaced-apart from annular member 42 in this example.

Referring back to FIG. 11, the inner platform 46 includes a lower rim 62 integrally formed with and extending downwards from the plate 48 towards the bottom 26 of the mounting assembly 22 in this example at a location adjacent to and radially-inwardly spaced from annular edge 50 of the plate. Lower rim 62 is adjacent to and radially-inwardly spaced from annular member 42 in this example. As seen in FIG. 9, the inner platform 46 includes a plurality of circumferentially spaced-apart elongate protrusions which radially outwardly extend from lower rim 62 towards annular edge 50 of plate 48, as seen by protrusion 65. Each of the protrusions is in the shape of a rectangular prism in this example.

Referring to FIG. 8, rim 62 and adjacent annular portions 53 of plate 48 positioned radially outwards therefrom are shaped to form a seat 97 for snugly receiving lip 47 of annular member 42 of inner housing 36. Put another way, inner platform 46 is shaped to extend overtop of and abut with inner housing 36 by way of lower rim 62 being received within and abutting lip 47. Protrusions 65 of inner platform 46, as seen in FIG. 9, are shaped and positioned to be received by slots 49 of annular member 42. In this manner, the inner platform is selectively removable from the rest of the inner housing to reveal interior contents of the inner housing as seen in FIG. 9.

As seen in FIG. 10, the exercise apparatus 20 includes a gear assembly 63 that includes a centrally-disposed first inner gear, in this example a sun gear 64. The sun gear is rotatably coupled to plate 38 of the inner housing 36. The sun gear 64 is disposed within the inner housing and has a plurality of circumferentially spaced-apart outwardly facing teeth 67 seen in FIG. 12. Referring back to FIG. 10, in this example an elongate member in the form of a bolt 66 centrally extends through a central aperture 68 of the sun gear. A pair of axially spaced-apart rotatable members, in this example in the form of upper and lower bearings 70 and 72 rotatably couple the sun gear 64 to the bolt. An annular spacer 74 extends around bolt 66 and is interposed between the inner race 103 of lower bearing 72 and plate 38 of the inner housing 36. The bolt couples to plate 38 via a nut 101 positioned adjacent to the bottom 26 of the mounting assembly 22. The manner in which gear 64 rotatably couples to housing 36 is an example only and other manners of rotatably mounting the gear are possible. Rotatably coupling of gears to housings is known per se and therefore will not be described in further detail.

As seen in FIG. 9, the exercise apparatus 20 includes a weight mount, in this example a flywheel 69. The flywheel is generally annular in shape in this example, and has a top 71 and bottom 73, seen in FIG. 10, opposite the top. The bottom of the flywheel 69 couples to the sun gear 64 in this example via a plurality of circumferentially spaced-apart threaded members as seen by threaded shaft 75. The threaded shafts threadably engage with the sun gear at lower ends 83 thereof and couple to flywheel 69 adjacent upper ends 85 thereof via nuts 89 in this example. A plurality of spacers 91 extend about respective ones of the threaded shafts 75 and are interposed between the bottom 73 of the flywheel 69 and sun gear 64.

Figure 12:
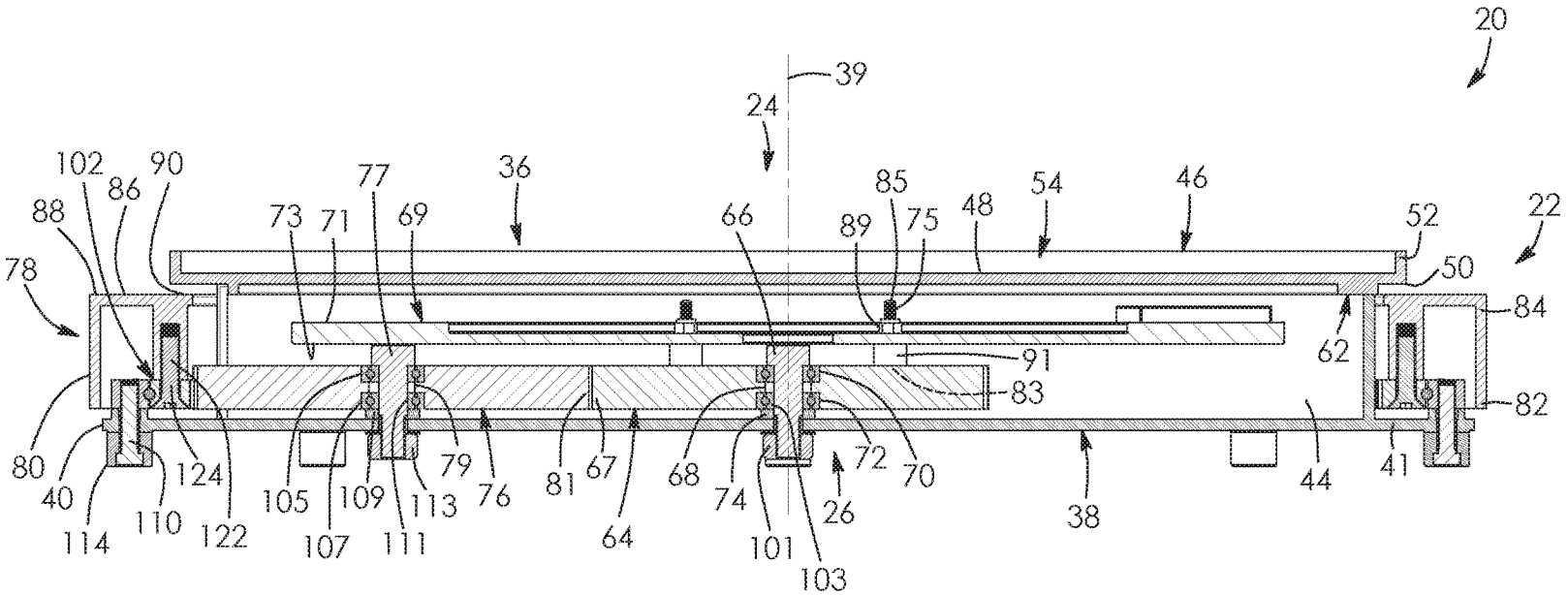
FIG. 12 is a cross-sectional view taken along lines 12-12 in FIG. 1 of the mounting assembly of FIG. 1.

As seen in FIG. 9, the flywheel includes a plurality of circumferentially spaced-apart receptacles 93 that are wedge-shaped with radially spaced-apart inner and outer edges 151 and 153 thereof which are arcuate-shaped in this example. The receptacles extend upwards from the bottom 73 of the flywheel towards the top 71 thereof. The exercise apparatus 20 includes a plurality of weights 95 and the receptacles are shaped to receive selective ones of said weights. As seen in FIG. 12, the flywheel is disposed within and enclosed by the inner housing 36. As seen in FIG. 9, the flywheel is in communication with the inner platform 46.

As seen in FIG. 9, the gear assembly 63 further includes a second inner gear in this example, in the form of a planetary gear 76. The planetary gear includes a plurality of circumferentially spaced-apart, outwardly facing teeth 81. A portion 99 of the teeth are positioned to extend through opening 37 of annular member 42 of inner housing 36. As seen in FIG. 12, the planetary gear 76 rotatably couples to plate 38 of inner housing 36. In this example, an elongate member in the form of a bolt 77 centrally extends through a central aperture 79 of the planetary gear. A pair of axially spaced-apart rotatable members, in this example in the form of upper and lower bearings 105 and 107 rotatably couple the planetary gear to the bolt. An annular spacer 109 extends around bolt 77 and is interposed between the inner race 111 of lower bearing 107 and plate 38 of the inner housing 36. The bolt couples to plate 38 via a nut 113 positioned adjacent to the bottom 26 of the mounting assembly 22. The manner in which gear 76 rotatably couples to housing 36 is an example only and other manners of mounting the gear to this end are possible. Rotatable coupling of gears to housings is known per se and therefore will not be described in further detail. The planetary gear 76 is shaped to be positioned radially outwards from sun gear 64. As seen in FIG. 12, teeth 81 of the planetary gear, as seen in FIG. 9, are shaped to rotatably engage with teeth 67 of sun gear 64.

As seen in FIG. 1, the exercise apparatus 20 includes an outer housing 78 which is hollow in this example. The outer housing extends around and is rotatable relative to inner housing 36. The outer housing 78 includes an outer annular peripheral portion, in this example in the form of annular member 80. As seen in FIG. 10, the annular member is generally vertically-extending in this example and has a lower end 82 adjacent to bottom 26 of the mounting assembly 22 and an upper end 84 adjacent to the top 25 of the mounting assembly Annular member 80 in this example aligns with and is spaced-apart above annular edge 40 of plate 38 of the inner housing. As seen in FIG. 11, lower end 82 of annular member 80 is adjacent to and spaced-apart above annular edge 40 of plate 38 of inner housing 36 in this example Annular member 80 is radially-outwardly spaced-apart from and extends about annular member 42 of inner housing 36.

Outer housing 78 further includes an annular top in this example in the form of an upper annular flange 86 coupled to and integrally formed with annular member 80 of the outer housing 78. The flange has an outer annular end 88 and an inner annular end 90 radially-inwardly spaced from said outer end. In this example, outer end 88 of flange 86 couples to and extends radially-inwardly from upper end 84 of annular member 80. Inner annular end 90 of flange 86 of the outer housing 78 is adjacent to and radially-outwardly spaced from end 45 of annular member 42 of inner housing 36 in this example.

Outer housing 78 includes a plurality of circumferentially spaced-apart hollow cylindrical members, in this example in the form of sleeves coupled to and extending downwards from flange 86, as seen by sleeve 92. The sleeves are adjacent to and radially-outwardly spaced from inner ends 90 of the flange in this example. The sleeves 92 have upper ends 94 coupled to and integrally formed with flange 86 in this example and lower ends 96 spaced-apart below said upper ends. The lower ends 96 of the sleeves are positioned adjacent to and spaced-apart above plate 38 of inner housing 36 in this example. Centrally-disposed threaded bores 98 extend through the sleeves 92 from ends 96 to ends 94 thereof in this example.

As seen in FIG. 9, the gear assembly 63 of the exercise apparatus 20 includes a geared bearing 102 in this example. The slewing bearing comprises an inner race 104 and an outer race 106 rotatably coupled to said inner race. As seen in FIG. 11, the outer race of the slewing bearing 102 is adjacent to and radially-inwardly spaced from lower end 82 of annular member 80. As seen in FIG. 9, the outer race 106 of the geared bearing 102 has a plurality of circumferentially spaced-apart threaded apertures 108 and is coupled to plate 38 of inner housing 36 in this example via an elongate members, in this example bolts 110 which threadably engage with said apertures as seen in FIG. 11.

The outer head portions 112 of the bolts 110 extend downwards from plate 38 of the inner housing in this example. The exercise apparatus 20 further includes a plurality of circumferentially spaced-apart cushioning members, in this example rubber knobs 114 as seen in FIG. 1, which extend around respective ones of the outer head portions 112 of the bolts as seen in FIG. 11. Referring to FIG. 1, the knobs are generally cylindrical in shape in this example and function as an interface between the mounting assembly 22 and floor 117.

Referring back to FIG. 11, the inner race 104 of geared bearing 102 rotatably couples to outer race 106 thereof via a plurality of circumferentially spaced-apart balls 116 in this example. As seen in FIG. 9, a plurality of circumferentially spaced-apart apertures extend through inner race 104 as seen by aperture 118. As seen in FIG. 11, the apertures 118 have tapered portions 120 which extend from adjacent to bottom 26 of mounting assembly 22 towards top 24 thereof. As seen in FIG. 11, inner race 104 is adjacent to and radially-outwardly spaced from annular member 42 of inner housing 36. The sleeves 92 of outer housing 78 are shaped to align with apertures 118 of inner race 104 of gear bearing 102. The inner race of geared bearing couples to outer housing 78 in this example via a plurality of circumferentially spaced-apart elongate members, in this example in the form of bolts 122. The bolts are shaped to be threadably received by apertures 118 of inner race 104 of geared bearing 102 and be received by threaded bore 98 of sleeve 92.

As seen in FIGS. 9 and 11, the geared bearing 102 includes a plurality of circumferentially spaced-apart and inwardly extending teeth 124 shaped to threadably engage with teeth 81 of planetary gear 76 seen in FIG. 9 at a location adjacent to opening 37 of annular member 42 of inner housing 36. As seen in FIG. 11, the outer housing 78 includes and is formed via radially spaced-apart and vertically-extending annular members 42 and 80, annular outer peripheral edge portion 41 of base plate 38 extending between said annular members 42 and 80 and annular flange 86 extending between said annular members 42 and 80. The outer housing is thus hollow and generally annular in shape and functions to house and enclose the geared bearing 102.

Referring to FIG. 1, the apparatus 20 includes a handlebar 126. The handlebar is u-shaped in this example and has an upper end 127 that is arc-shaped and a pair of spaced-apart lower ends 128 and 130 opposite said upper end. As seen in FIG. 13, the upper end of the handlebar 126 shaped to align with the curvature of annular member 80 of outer housing 78 and thus curves about axis 39 of the mounting assembly 22. As seen in FIGS. 5 and 13, the upper end 127 of the handlebar 126 is curved in side and top profiles. As seen in FIG. 5, the upper end of the handlebar radially-extends outwards relative to the lower ends 130 thereof. As seen in FIG. 13, handlebar 126 aligns with and extends in parallel with upper annular flange 86 of outer housing 78 in this example.

As seen in FIG. 8, the lower ends 128 of the handlebar 126 selectively couple to and are circumferentially spaced-apart on outer housing 78. In particular, in this example the lower ends of the handlebar extend through apertures 132 of the upper annular flange 86 of outer housing and are received by sockets 134 of the outer housing. The sockets 134 are hollow and generally cylindrical in shape, couple to and extend downwards from flange 86 and couple to and extend radially-inwards from annular member 80 adjacent to upper end 84 thereof. Annular member 80 has a pair of circumferentially spaced-apart apertures extending therethrough which are in communication with the sockets, as seen by aperture 136 in communication with socket 134 in FIG. 8.

In this example, the lower ends 128 and 130 of the handlebar 126 include connector mechanisms in the form of outwardly-biased spring-loaded pins 138 shaped to selectively extend through apertures 136 of annular member 80 and be spring-biased outwards via corrugated spring 139 in this example. In this manner, the handlebar 126 is selectively coupled to the outer housing 78.

As seen in FIG. 1, the handlebar 126 includes a pair of outer tubes 140 and 142 which extend upwards from lower ends 128 and 130 thereof to upper ends 144 and 146 of the tubes. A plurality of longitudinally-spaced-apart apertures 148 extend into said tubes at located adjacent to ends 128 and 130 and 144 and 146, respectively. The handlebar 126 includes an upper, u-shaped tube 150 which extends from the upper end 127 of the handlebar towards the lower ends 128 and 130 thereof. The u-shaped tube in this example has lower ends 152 and 154 shaped to be received within the upper ends 144 and 146 of tubes 140 and 142. The handlebar 126 in this example has a pair of connector mechanisms in the form of outwardly-biased spring-loaded pins 156 and 158 shaped to selectively extend through apertures 148 of tubes 140 and 142. In this manner, the handlebar 126 is telescoping with tube 150 being selectively receivable within tubes 140 and 142. Referring to FIG. 1, the length L of the handlebar, as extending from its lower ends 128 and 130 to its upper end 127 thereof, is thus adjustable as generally indicated by arrow of numeral 131.

Outwardly-biased spring-loaded pins, including their various parts and functionings, are well known to those skilled in the art and therefore will not be described in further detail.

In operation and referring to FIGS. 13 and 14, the user 60 may align his or her feet 56 and 58 in a forward position on top of plate 48 of inner platform 46. The user grips the handlebar 126 adjacent to the upper end 127 thereof, and selectively twist his or her upper body 61 relative to his or her lower body 59 from the left to the right to varying degrees in clockwise and counter-clockwise directions. This is generally indicated by arrow of numeral 162. For example, FIG. 14 shows the upper body 61 being angularly displaced relative to the lower body 59 of the user 60 by an angle $\alpha$. In this manner, the outer housing 78 of the exercise apparatus 20 is thus selectively rotated relative to the inner housing 36 and inner platform 46 seen in FIG. 10. Flywheels 69 having various weights 95 and/or combinations may be chosen by the user for selectively adjusting the moment of inertia thereof and the amount of torque required to rotate inner race 104 of geared bearing 102.

Figure 15:
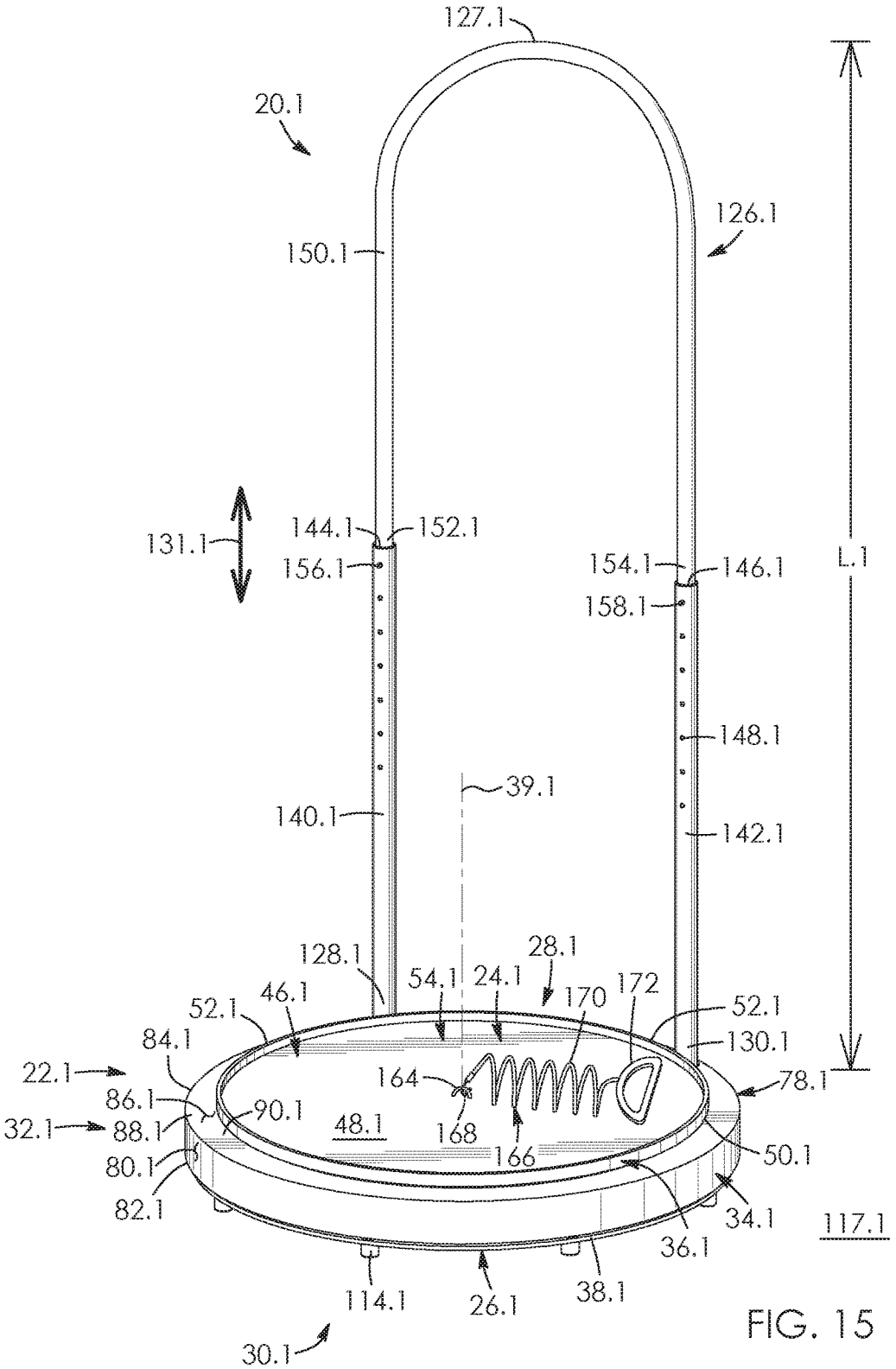
FIG. 15 is a top perspective view of an exercise machine according to a second aspect.

FIG. 15 shows an exercise apparatus 20.1 according to a second aspect. Like parts have like numbers and functions as the exercise apparatus 20 shown in FIGS. 1 to 10 with the addition of "0.1". Exercise apparatus 20.1 is substantially the same as exercise apparatus 20 shown in FIGS. 1 to 14 with at least the following exceptions.

Apparatus 20.1 includes a connector 164 which in this example is u-shaped, and which is centrally-disposed upon, couples to and extends upwards from plate 48 of inner platform 46. The apparatus further includes an exercise resistance band 166 which may couple with the connector via a hooked-end 168, for example. The exercise resistance band includes a resilient elongate member 170 and a gripping end 172 spaced-apart from the hooked-end. Exercise resistance band 166 connecting to the mounting assembly 22.1 enables the user to perform further exercises in combination with the apparatus 20.1.

It will be appreciated that many variations are possible within the scope of the invention described herein. It will also be understood by someone skilled in the art that many of the details provided above are by way of example only and are not intended to limit the scope of the invention which is to be determined with reference to at least the following claims.

What is claimed is:

1. An exercise apparatus comprising:

an inner housing upon which a user may stand;

an annular outer housing rotatably coupled to and extending around the inner housing;

a handlebar coupled to and extending upwards from said outer housing; and a mount for retaining one or more weights thereon, the mount operatively connecting to the outer housing and being enclosed within the inner housing, wherein the inner housing is stationary.

2. The apparatus as claimed in claim 1 wherein the mount is annular in shape and includes a plurality of circumferentially spaced-apart receptacles for receiving said weights.

3. The apparatus as claimed in claim 1 wherein the inner housing includes a base plate that is circular in shape, an annular member coupled to and extending upwards from said base plate, and an inner platform upon which the user stands, the inner platform being shaped to abut with, extend overtop of and being selectively removable from said annular member.

4. The apparatus as claimed in claim 1 wherein the inner housing includes a vertically-extending annular member and an inner platform shaped to extend overtop of the annular member, the inner platform including a lower rim shaped to fit within the annular member and an upper rim spaced radially outwards from the lower rim, the upper rim extending upwards and forming an enclosure for receiving the user's feet therewithin.

5. The apparatus as claimed in claim 1 wherein the outer housing rotates about a vertically-extending central axis and wherein the apparatus further includes at least one inner gear rotatable about said axis, rotatably connected to the inner housing and operatively connected to the outer housing, the mount coupling to said at least one inner gear.

6. The apparatus as claimed in claim 1 wherein the inner housing includes a removable cover in communication with the mount.

7. The apparatus as claimed in claim 1, the apparatus further including a plurality of weights.

8. The apparatus as claimed in claim 1 wherein the outer housing is hollow and is shaped to receive a geared bearing therewithin, the geared bearing having an inner race coupled to the outer housing and an outer race coupled to the inner housing.

9. The apparatus as claimed in claim 8 wherein the inner race of the geared bearing has a plurality of circumferentially spaced-apart apertures extending therethrough, wherein the outer housing includes an annular top and a plurality of circumferentially spaced-apart inwardly-threaded sleeves coupled to and extending downwards from said top, and wherein the apparatus further includes a plurality of threaded members shaped to threadably engage with said sleeves and extend through said apertures of the inner race of the geared bearing for coupling the inner race to the outer housing.

10. The apparatus as claimed in claim 1, the apparatus further including a sun gear rotatably coupled to and positioned within the inner housing, a geared bearing having an outer race coupled to the inner housing, an inner race coupled to the outer housing and a plurality of circumferentially spaced-apart and inwardly extending teeth, and a planetary gear rotatably coupled to the inner housing, the planetary gear rotatably coupling the sun gear and the inner race of the geared bearing together.

11. The apparatus as claimed in claim 10, wherein the outer housing is rotatable about a vertically-extending axis, the sun gear being rotatable about said axis, and wherein the planetary gear is radially-spaced apart from said axis.

12. The apparatus as claimed in claim 10 wherein the mount operatively couples to the sun gear.

13. The apparatus as claimed in claim 1 wherein the outer housing includes a vertically-extending annular member and wherein the handlebar aligns with and extends in parallel with said annular member.

14. The apparatus as claimed in claim 1 wherein the outer housing includes an annular top which extends about the inner housing and wherein the handlebar aligns with and extends parallel to said top.

15. The apparatus as claimed in claim 1, wherein the handlebar is u-shaped, has spaced-apart lower ends coupled to said outer housing and has an upper end spaced-apart from said lower ends thereof, the upper end of the handlebar radially-extending outwards relative to said lower ends.

16. The apparatus as claimed in claim 1 wherein the handlebar is u-shaped, has spaced-apart lower ends coupled to said outer housing and has an upper end spaced-apart from said lower ends thereof, the upper end of the handlebar being curved in side and top profiles.

17. The apparatus as claimed in claim 1, further including an exercise resistance band coupled to and extending outwards from said inner housing.

18. The apparatus as claimed in claim 17 wherein the band is centrally disposed upon and selectively connectable to said inner housing at a first end thereof and includes a second end spaced-apart from the first end, and wherein the apparatus further includes a gripping handle coupled to said second end.

19. An exercise apparatus comprising:

an inner platform upon which a user may stand;

an outer annular member which is rotatable about a vertically-extending central axis, the outer annular member extending around and rotatably connecting to the inner platform; and a geared bearing having an outer race operatively coupled to the inner platform and an inner race rotatably connected to the outer race, the inner race of the geared bearing operatively connecting to the outer annular member.

* * * * *